United States Patent [19]

Stahlecker et al.

[11] Patent Number: 4,985,967

[45] Date of Patent: Jan. 22, 1991

[54] DRAFTING UNIT FOR A SPINNING MACHINE WITH MOVABLE COVER

[75] Inventors: Fritz Stahlecker, Josef-Neidhart-Strasse 18, 7347 Bad Uberkingen; Hans Stahlecker, Haleenstrasse 20, 7334 Sussen, both of Fed. Rep. of Germany

[73] Assignees: Fritz Stahlecker; Hans Stahlecker, both of Fed. Rep. of Germany

[21] Appl. No.: 473,161

[22] Filed: Jan. 31, 1990

[30] Foreign Application Priority Data

Mar. 10, 1989 [DE] Fed. Rep. of Germany ..... 3907745

[51] Int. Cl.[5] ..... D01H 1/16

[52] U.S. Cl. ..... 19/267; 19/245; 19/262; 19/263; 19/284

[58] Field of Search ..... 19/245, 262, 263, 266, 19/267, 271, 278, 279, 280, 284, 281; 18/200, 207, 208

[56] References Cited

U.S. PATENT DOCUMENTS

| | | | |
|---|---|---|---|
| 1,942,329 | 1/1934 | Gégauff | 19/281 X |
| 2,075,595 | 3/1937 | Whiting | 19/245 X |
| 2,834,062 | 5/1958 | Toenniessen | 19/262 X |
| 3,015,860 | 1/1960 | Stahlecker | 19/267 |
| 3,287,768 | 12/1965 | Rakhorst | 19/263 X |
| 3,377,665 | 4/1968 | Kincaid | 19/263 |
| 3,409,944 | 11/1968 | Kajimura et al. | 19/262 |
| 3,523,335 | 8/1970 | Ingham, Jr. | 19/263 |
| 3,712,509 | 1/1973 | Carroll | 181/200 X |
| 3,885,272 | 5/1975 | Marzoli | 19/245 |
| 4,346,782 | 8/1982 | Böhm | 181/207 |
| 4,370,781 | 2/1983 | Murao | 19/245 |
| 4,538,329 | 9/1985 | Sakai et al. | 19/267 X |
| 4,557,022 | 12/1985 | Morishita et al. | 19/281 X |

FOREIGN PATENT DOCUMENTS

| | | | |
|---|---|---|---|
| 3209210 | 11/1985 | Fed. Rep. of Germany . | |
| 3143215 | 2/1986 | Fed. Rep. of Germany . | |
| 1232027 | 10/1960 | France | 19/281 |
| 3050534 | 3/1988 | Japan | 19/245 |
| 284770 | 12/1952 | Switzerland | 19/245 |
| 10238 | of 1894 | United Kingdom | 19/284 |
| 2770 | of 1897 | United Kingdom | 19/284 |
| 745156 | 2/1956 | United Kingdom | 19/278 |

*Primary Examiner*—Werner H. Schroeder
*Assistant Examiner*—John J. Calvert
*Attorney, Agent, or Firm*—Evenson, Wands, Edwards, Lenahan & McKeown

[57] ABSTRACT

In the case of a drafting unit for a spinning machine, a loading support is provided which has two arms extending in parallel with respect to one another at a distance which accommodate the holding devices for the shafts of the pressure roller twins and which are reinforced to form a frame by means of cross-struts. In addition, a cover is provided which covers the loading support and the pressure rollers and which can be swiveled away without interrupting the spinning operation.

17 Claims, 3 Drawing Sheets

DRAFTING UNIT FOR A SPINNING MACHINE WITH MOVABLE COVER

BACKGROUND AND SUMMARY OF THE INVENTION

The invention relates to a drafting unit for a spinning machine having a loading support which is pivotable around a supporting rod extending in parallel with respect to bottom rollers and can be locked in its operative position and which has two arms extending parallel at a distance from one another, which accommodate holding devices for shafts of pressure rollers which are constructed as pressure roller twins assigned to two adjacent spinning points, and having a pivotable cover covering the loading support.

In the case of a known drafting unit of the initially mentioned type (DE-C 32 09 210), the two arms of the loading support are each separately pivotable and can each be locked separately. In the known construction, a cover is also provided which covers the two arms and the area located in between. This cover is mounted at locking levers of which one is in each case assigned to one of the arms. The area of the pressure rollers is covered by additional flaps which can be pivoted separately. It is not possible to swivel the cover open without interrupting the operation of the drafting unit.

It is also known (DE-C 31 43 215) to provide a loading support manufactured as a cast part which has two guides respectively for the pressure rollers and one loading device which is arranged in the center between them. In this construction, the locking of the loading support in the operative position takes place by means of a locking device arranged at the end of the loading support facing away from the holding rod.

An object of the invention is to develop a drafting unit of the initially mentioned type such that the loading support can have a sturdy construction and that the area of the drafting unit can be made accessible for a cleaning without the requirement of moving the loading support out of its operative position.

This object is achieved according to preferred embodiments of the invention in that the two arms of the loading support are-connected at their ends by means of cross-struts to form a frame which, in the area of one cross-strut, is disposed on the supporting rod, and in that the cover is disposed such that it can be swivelled away when the the loading support is locked in its operative position.

As a result of the frame construction, the support has a high stability. Nevertheless, it is not necessary to provide two independent bearings and locking devices. In addition, it is possible to swivel the cover away without having to also swivel the loading support. As a result, it is possible to make the area of the loading support and also the interior area of the cover accessible to a cleaning by means of a suction nozzle or a blowing nozzle without the requirement of interrupting the operation of the drafting unit.

In a further development of preferred embodiments of the invention, it is provided that the loading support with the parallel arms and the cross-struts is constructed as a punched and edged sheet-metal profile. This permits a relatively light but still very stable construction.

In a further development of preferred embodiments of the invention, a locking device for the loading support is provided which is applied to the cross-strut facing away from the supporting rod. As a result, the operative position is locked securely while the forces distribute themselves more evenly.

In an expedient development of preferred embodiments of the invention, it is provided that the cover, covers the locking device in its covering position. As a result, a smooth outer contour is made possible. In this case, it is provided in an expedient further development that the cover covers the loading support and the pressure rollers held by it. The covers, which are assigned to two spinning points respectively, thus cover the whole drafting unit area so that a closed streamlined design is obtained.

In a further development of preferred embodiments the invention, it is provided that the cover is disposed such as the loading support that it can be pivoted around a swivelling axis which is in parallel to the supporting rod and that it can be locked at the loading support in its covering position. In this development, the loading support and the cover form a structural unit which, if required, can be demounted as a whole and, if necessary, can be exchanged for a new loading support with a cover.

In order to shield the operating side from the noises caused by the drafting unit, it is provided in a further development of the invention that the cover, preferably on its interior side, is provided with noise-suppressing material.

In a further development of preferred embodiments of the invention, it is provided that the cover is equipped with cleaning devices assigned to the pressure rollers which can be swivelled away from the pressure rollers together with the cover. The cleaning devices can therefore be swivelled away from the pressure rollers together with the cover without the necessity of interrupting the operation of the drafting units. It is therefore possible to also make the cleaning devices accessible to a cleaning without interrupting the operation.

In a further development of preferred embodiments of the invention, it is provided that the cleaning devices contain cleaning rags constructed as continuous loops, these cleaning rags each moving around a roller which is coaxial with respect to the swivelling axis of the cover. As a result, it is possible to drive the cleaning rags by way of the rollers which are coaxial with respect to the swivelling axis without impairing the swivelling-away of the cover.

In a further development of preferred embodiments of the invention, it is provided that the cover is equipped with a suction device which contains suction nozzles assigned to the cleaning devices and which is equipped with a section piece which, in the covering position of the cover, connects to a suction pipe. This suction device is therefore arranged in such a manner that it also does not interfere with the swivelling-away movement of the cover.

Other objects, advantages and novel features of the present invention will become apparent from the following detailed description of the invention when considered in conjunction with the accompanying drawings.

DETAILED DESCRIPTION OF THE DRAWING

Figure 1:
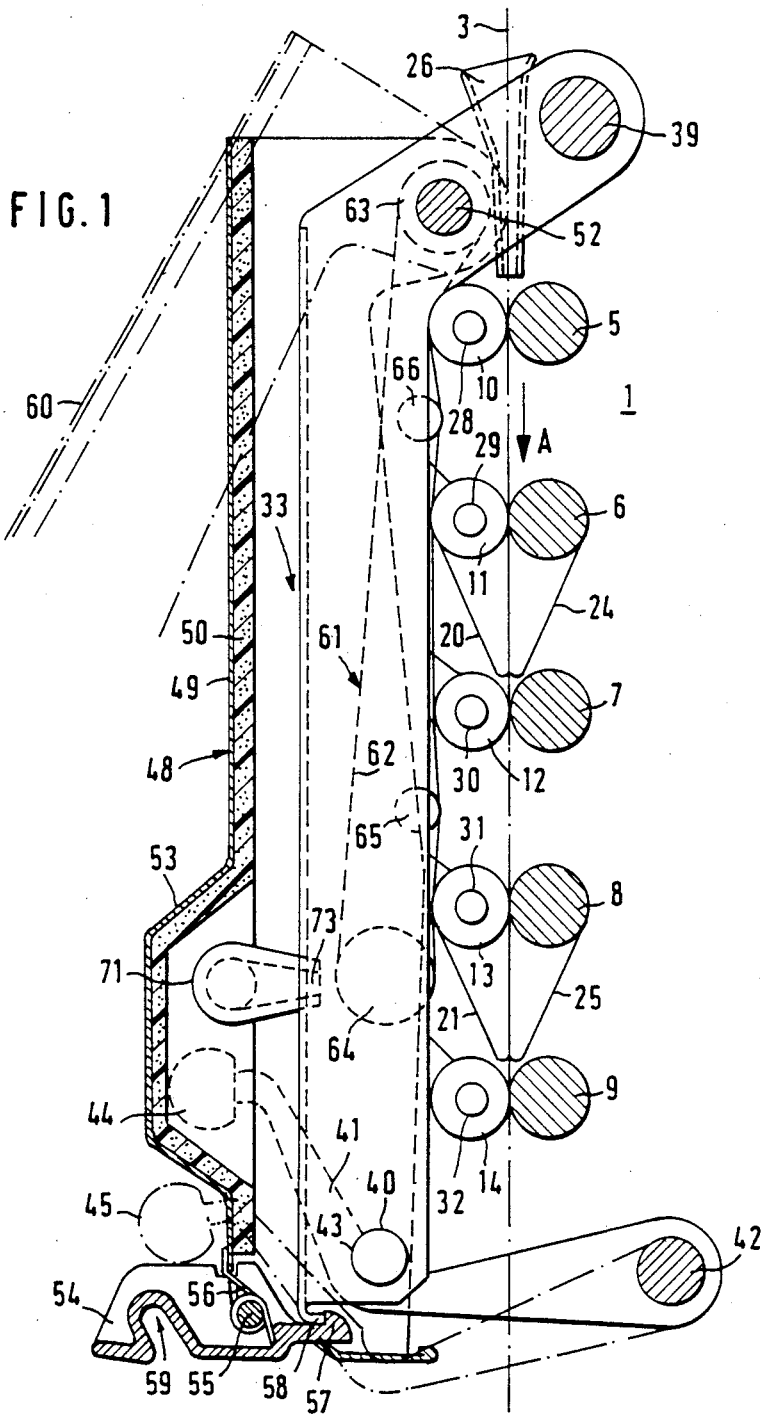
FIG. 1 is a sectional view of a drafting unit constructed according to a preferred embodiment of the invention, taken along Line I—I of FIG. 2.

The drafting unit shown in the drawing, or better, the two shown (FIG. 2) adjacent drawing units, are assigned to two adjacent spinning points 1, 2 of a spinning machine which comprises a plurality of spinning points and drafting units of this type in a row behind one another. In each spinning point 1, 2, a fiber sliver 3, 4 is processed which is shown by a dash-dotted line and moves through the drafting units in the direction of the arrows (A and B).

The drafting units contain common bottom rollers 5, 6, 7, 8, 9 which, in the embodiment shown, may be constructed as cylinders extended through in the longitudinal direction of the machine and which are driven at the machine end in a headstock of the spinning machine. However, in another embodiment, it may be provided that the bottom rollers 5, 6, 7, 8, 9 are constructed as short shaft sections which are each driven separately and which are each assigned to two adjacent spinning points 1, 2 or are each assigned to only one spinning point 1 or 2.

Pressure rollers 10, 11, 12, 13, 14 are part of the drafting unit of spinning point 1 which, in the operative position of the drafting unit, are pressed against the bottom rollers 5, 6, 7, 8, 9 by means of spring force. Correspondingly, pressure rollers 15, 16, 17, 18, 19 are part of the drafting unit of spinning point 2. Apron guides are provided in two of the four drafting zones. These apron guides consist of top aprons 20, 21, 22, 23 which wind around the pertaining pressure rollers 11, 13, 16, 18 and which, in a manner not shown in detail, in the area of the roller pairs following in passage direction of the sliver 3, 4, are guided around deflection guides. Correspondingly, bottom aprons 24, 25 are assigned to the bottom rollers 6, 8 in the same drafting zones. At the inlet of both drafting units, one respective feeding hopper 26, 27 is located through which the slivers 3, 4 are guided to the respective first pair of rollers 5, 10; 5, 15.

The pressure rollers 10, 15; 11, 16; 12, 17; 13, 18; 14, 19 of the two adjacent drafting units are constructed as so-called pressure roller twins. They are each disposed on common shafts 28, 29, 30, 31, 32 which are held by a common loading support 33.

Figure 3:
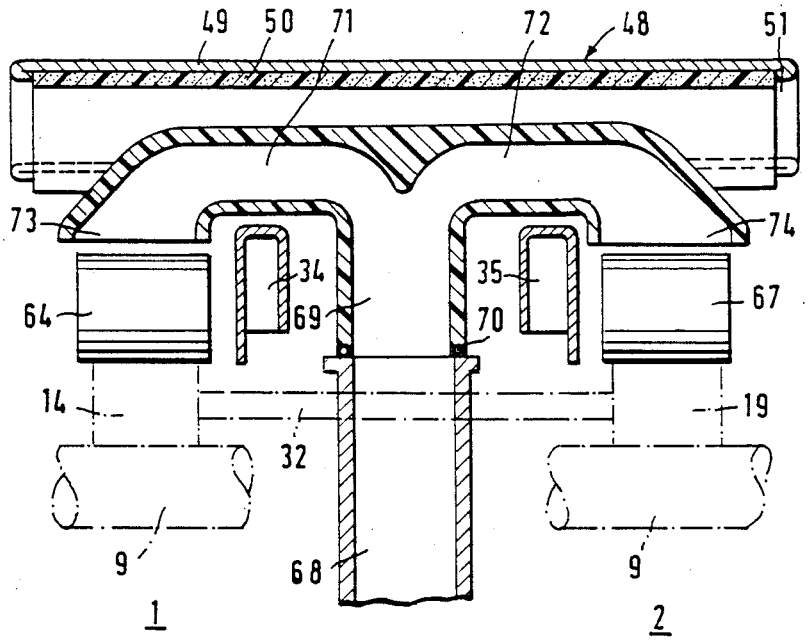
FIG. 3 is a sectional view along Line III—III of FIG. 2.

The loading support 33 has two arms 34, 35 which extend parallel to one another and which are arranged close to the faces of the pressure rollers 10 to 19. At their ends, the two arms 34, 35 are connected by means of cross-struts 36, 37 so that the whole support 33 is constructed as a frame. This frame is manufactured as a punched and edged sheet-metal profile. The arms 34, 35 have an essentially U-shaped cross-section which is open toward the bottom (FIG. 3). The respective outer legs of the U-shaped arms 34, 35 are extended into the area of the cross-struts 36, 37. The outer legs of the U-shaped arms 34, 35, in the area of the cross-strut 36, are lengthened in the manner of a lug and form bearing points by means of which the loading support 33 is pivotable on a holding rod 39 which is situated in the area of the feeding hoppers 26, 27 and which extends in parallel with respect to the bottom rollers 5, 6, 7, 8, 9. These lug-type lengthenings may be stiffened by edge foldings. Edge foldings of this type may also be provided as bearing points for the holding rod 39. Holding devices 46, 47 for the shafts 28, 29, 30, 31, 32 are arranged in the U-shaped arms 34, 35. These holding devices 46, 47 may, for example, be constructed as spring loaded guide rods. These holding devices 46, 47 may be fastened so that they can be adjusted in longitudinal direction of the arms 34, 35, and so that the drafting zone width can be adjusted to the fiber material of the slivers 3, 4 to be processed.

Figure 2:
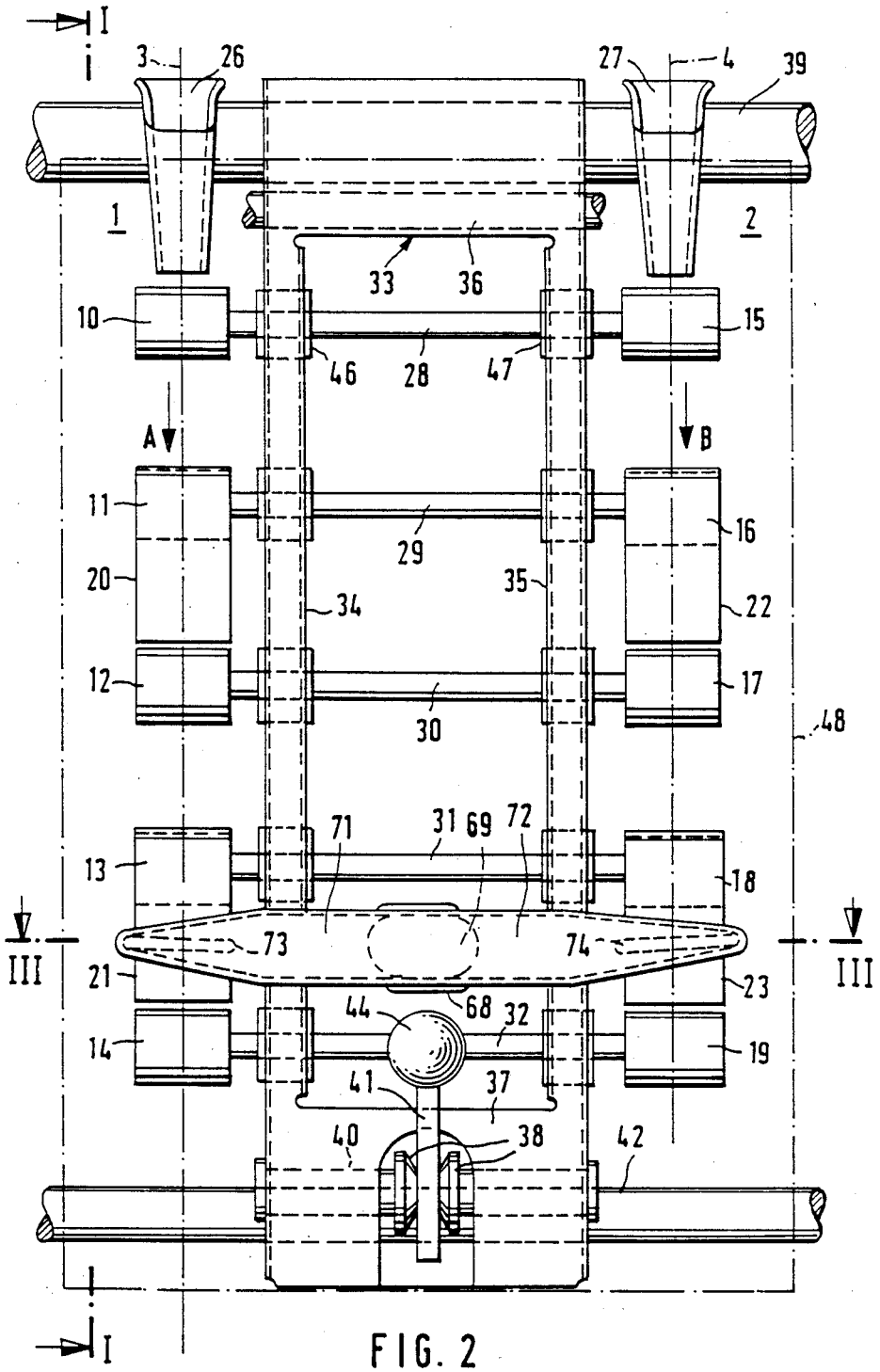
FIG. 2 is a top view of the drafting unit of FIG. 1, in which the cover is only outlined and the cleaning devices are not shown.

The support 33 is locked in the shown operative position (FIG. 1). This locking system is applied to the cross-strut 37 facing away from the supporting rod 39 so that a favorable distribution of force is obtained within the support 33. At a swivel shaft 42 which is fixed at the machine and extends in longitudinal direction of the machine, a locking lever 41 is pivotably arranged which, by means of a detent cam 43, reaches around a locking pin 40 arranged transversely inside the cross-strut 37. The locking pin 40 ks equipped with two guide disks 38 which are provided with diagonal guide surfaces facing one another, the shortest spacing of which is essentially adapted to the width of the locking lever 41. This results in a transverse securing of the support 33 with respect to the locking lever 41 arranged on the swivel shaft 42. The locking lever 41 is equipped with a handle 44 projecting to the operating side and can be swivelled into the unlocked position shown by a dash-dotted line in FIG. 1, in which it releases the locking pin 40. As shown in FIG. 2, the cross-strut 37 is provided with a notch, in the area of which the locking lever 41 can be swivelled toward the locking pin 40 and away from it. The locking pin 40 which extends between the two outer edge foldings, results in a further stiffening of the cross-strut 37.

The whole area of the two drafting units, to which the common loading support 33 belongs, is covered by a cover 48. This cover 48 covers the pressure rollers 10 to 19 as well as the area located in between. As shown in FIG. 2, the cover 48 extends laterally beyond the pressure rollers 10 to 19. By way of a joint, the cover of the respective next drafting units will then follow, so that a closed machine front is obtained. The cover 48 is provided with a bead-type bulge 53 by means of which it reaches over the area of the locking lever 41. This bead-type bulge 53 is used as a reinforcement. In the shown embodiment, the cover 48 is produced from a metal sheet 49 but it may easily also be produced of plastic material because it does not have to absorb any forces. In the area of the supporting rod 39, the cover 48 can be pivoted around a swivel shaft 52 which is parallel to it and which is mounted at the cross-strut 36 of the support 33. At its opposite end, it is equipped with a locking lug 54 by means of which it can be locked with respect to the support 33. This locking lug 54 preferably consists of a plastic component which is pivotably disposed on a pin 55 held at the cover 48. The locking position is secured by means of a torsion spring 56. The locking lug 54 has a hook-shaped end 57 by means of which it reaches under a folded edge 58 of the end of the support 33 facing away from the supporting rod 39. The locking lug 54 is provided with a grip recess 59 into which a corresponding operating element of a movable cleaning device can also engage. The cover 48 is pivotable into the position 60 which is dash-dotted in FIG. 1 so that, as a result, the loading supports 33 and the upper rollers 10 to 19 are exposed without the requirement of opening the drafting units for this purpose. An opening of the drafting units by the operation of the locking lever 41 becomes possible only when the cover 48 is swivelled away.

As also shown in FIG. 1, the cover 48 is provided with noise-reducing material 50 on the interior side. Since the cover 48 reaches over the two drafting units in a generous manner, the operating side is shielded with respect to the noises generated by the drafting units.

As also shown in FIG. 1, the cover 48 is equipped with cleaning devices for the top rollers 10, 11, 12, 13; 15, 16, 17, 18. This cleaning device 61 does not extend to the pair of delivery rollers, because normally a suction device is assigned to this pair of delivery rollers by means of which the continuing sliver is sucked off in the case of a yarn breakage. This suction device therefore also causes a cleaning of this pair of rollers.

The cleaning devices 61 each contain cleaning rags 62 in the form of continuous loops which move around two rollers 63, 64. Roller 63 is arranged coaxially with respect to the swivel shaft 52 of the cover 48 so that this roller 63 also does not change its position when the cover 48 is swivelled away. It may therefore be used for the connection of a drive which is not shown and which is derived, for example, from the bottom roller 5.

A suction device which is fastened to the cover 48 in a manner not shown in detail is also part of the cleaning device 61. This suction device comprises a body which is preferably made of plastic and contains two ducts 71, 72 leading to suction nozzles 73, 74 which are located opposite the cleaning rags 62 in the area of the rollers 64, 67. The ducts 71, 72 change into a connecting piece 69 which, in the covering position of the cover 48, by means of an inserted sealing device 70, connects to a suction pipe 68. When the cover 48 is swivelled away, the connection between the suction pipe 68 and the suction piece 69 is separated. The suction device is expediently mounted at the cover 48 by means of spring-elastic devices which are not shown, so that a tight connection is ensured during the operation. These spring-elastic devices will then also provide that the locking lug 54 by means of its hook-shaped part 57 is pulled to the folded edge 58 of the support 33. As shown in FIG. 1, the suction device is located in the area of the bead-type bulge 53.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A spinning machine arrangement including a plurality of adjacent spinning units and at least one drafting unit incorporated therewith, said drafting unit comprising:

bottom rollers, pressure rollers, a load support for said pressure rollers, said loading support including means for accommodating holding devices for shafts of said pressure rollers, said loading support being pivotable around a supporting rod extending in parallel with respect to said bottom rollers between an operative position adjacent the bottom rollers for drafting operation and an inoperative position disposed further from the bottom rollers, locking means for locking the loading support in its operative position, said loading support having two arms extending parallel to and at a distance from one another so as to form pressure roller twins assigned to two adjacent ones of said spinning units, said two arms of said loading support being connected at their ends by means of respective cross-struts to form a frame which is disposed on the supporting rod in the area of one of the cross-struts, and a pivotable loading support cover for covering the loading support, wherein said loading support cover is disposed such that it can be pivoted away when the loading support is locked in said operative position to accommodate maintenance of the loading support and pressure rollers without disturbing the loading support from its operative position.

2. A spinning machine according to claim 1, wherein the loading support with the parallel arms and the cross-struts is constructed as a punched and edged sheet-material profile.

3. A spinning machine according to claim 1, wherein a locking device for the loading support is provided which is applied to the cross-strut facing away from the supporting rod.

4. A spinning machine according to claim 2, wherein a locking device for the loading support is provided which is applied to the cross-strut facing away from the supporting rod.

5. A spinning machine according to claim 1, wherein the loading support cover, in its covering position, covers a locking device for the loading support.

6. A spinning machine according to claim 1, wherein the loading support cover covers the loading support and the pressure rollers held by it.

7. A spinning machine according to claim 5, wherein the loading support cover covers the loading support and the pressure rollers held by it.

8. A spinning machine according to claim 1, wherein the loading support cover is disposed at the loading support so that it can be pivoted around a swivel shaft which is parallel to the supporting rod and at the loading support can be locked in its covering position.

9. A spinning machine according to claim 7, wherein the loading support cover is disposed at the loading support so that it can be pivoted around a swivel shaft which is parallel to the supporting rod and at the loading support can be locked in its covering position.

10. A spinning machine according to claim 1, wherein the loading support cover, is provided with a noise-reducing material preferably at its interior side.

11. A spinning machine according to claim 1, wherein the loading support cover, is provided with a noise-reducing material preferably at its interior side.

12. A spinning machine according to claim 1, wherein the loading support cover is equipped with cleaning devices assigned to the pressure rollers, the cleaning devices being pivotable away from the pressure rollers together with the loading support cover.

13. A spinning machine according to claim 12, wherein the cleaning devices contain cleaning rags developed as continuous loops, which each move around a roller which is coaxial with respect to the swivel shaft of the loading support cover.

14. A spinning machine according to claim 12, wherein the loading support cover is equipped with a suction device which contains suction nozzles assigned to the cleaning devices and which is equipped with a suction piece which, in the covering position of the loading support cover, connects to a suction pipe.

15. A spinning machine according to claim 13, wherein the loading support cover is equipped with a suction device which contains suction nozzles assigned to the cleaning devices and which is equipped with a suction piece which, in the covering position of the loading support cover, connects to a suction pipe.

16. A spinning machine according to claim 8, wherein the loading support cover is equipped with cleaning devices assigned to the pressure rollers, the cleaning devices being pivotable away from the pressure rollers together with the loading support cover.

17. A spinning machine according to claim 9, wherein the loading support cover is equipped with cleaning devices assigned to the pressure rollers, the cleaning devices being pivotable away from the pressure rollers together with the loading support cover.

* * * * *